US006373360B1

(12) United States Patent
Miyamoto et al.

(10) Patent No.: US 6,373,360 B1
(45) Date of Patent: Apr. 16, 2002

(54) IMAGE DISTORTION CORRECTING DEVICE

(75) Inventors: Yoshinori Miyamoto; Hironobu Yasui; Akinori Heishi; Akira Ishimori; Hiroaki Nishino, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/702,853

(22) Filed: Nov. 1, 2000

(30) Foreign Application Priority Data

May 8, 2000 (JP) ..... 2000-134624

(51) Int. Cl.[7] ..... G06G 1/04; H01J 29/56; H01J 29/70; H01F 7/00; H01F 1/00

(52) U.S. Cl. ..... 335/210; 335/212; 335/213; 313/440; 315/370

(58) Field of Search ..... 335/210–214; 313/440; 315/368.25, 368.26, 368.27, 368.28, 400, 370

(56) References Cited

U.S. PATENT DOCUMENTS 4,642,528 A * 2/1987 Kobayashi et al. ..... 315/368
4,833,432 A * 5/1989 Ohtsu et al. ..... 335/212
5,072,161 A * 12/1991 Ikeda et al. ..... 315/371

FOREIGN PATENT DOCUMENTS

| | | |
|---|---|---|
| JP | 3-182172 | 8/1991 |
| JP | 9-149283 | 6/1997 |
| JP | 11-261839 | 9/1999 |

* cited by examiner

*Primary Examiner*—Ramon M. Barrera
(74) *Attorney, Agent, or Firm*—Burns, Doane, Swecker & Mathis, LLP

(57) ABSTRACT

An image distortion correcting device with reduced cost and reduced consumption power is provided. Horizontal correction coils (L1) and (L2) are wound around partial cores (4*a*) and (4*b*). The two horizontal correction coils (L1) and (L2) are wound in such winding directions that they produce magnetic fields in opposite directions. A bobbin (5) having an insulating property covers the partial cores (4*a*) and (4*b*) and magnets (2) and (3) in the winding direction of the horizontal correction coils (L1) and (L2), and a vertical correction coil (L3) is wound on the bobbin (5) around the partial cores (4*a*) and (4*b*) along the windings of the horizontal correction coils (L1) and (L2). That is to say, the vertical correction coil (L3) is wound over the horizontal correction coils (L1) and (L2) along the periphery of their windings with the bobbin (5) interposed therebetween. This vertical correction coil (L3) is wound in such a direction that it produces a magnetic field directed to cancel the bias magnetic field produced by the magnets (2) and (3).

12 Claims, 13 Drawing Sheets

SCREEN POINT T(B)

SCREEN POINT L

SCREEN POINT R

SCREEN POINT TL(BL)

IMAGE DISTORTION CORRECTING DEVICE

BACKGROUND OF THE INVENTION

1. Field of the Invention

The present invention relates to an image distortion correcting device used in a CRT (Cathode-Ray Tube) display device.

2. Description of the Background Art

<Intermediate Pincushion Distortion of Vertical Lines>

FIG. 18 is a schematic diagram showing pincushion distortion of vertical lines in the intermediate areas (hereinafter referred to as "intermediate pincushion distortion"), which is often studied as a problem in CRT display devices used in current high-definition display monitors etc. In this diagram, vertical lines 23 are shown near the edges of the screen 20 and vertical lines 24 are shown in the intermediate areas of the screen (the intermediate areas between the central area and the marginal areas in the screen). When the vertical lines 23 in the marginal areas of the screen look approximately straight, the vertical lines 24 in the intermediate areas of the screen look distorted in a pincushion-like shape, which is called intermediate pincushion distortion.

It is difficult to solve such intermediate pincushion distortion only by controlling the magnetic field distribution of the deflection yoke.

Methods for correcting the intermediate pincushion distortion using circuitry include the well-known method of improved S-correction where the amount of S-correction is varied in the vertical scanning period (hereinafter simply referred to as vertical period).

<S-correction>

First, the S-correction is described. The S-correction is a correcting method in which the horizontal deflection current is modulated from a sawtooth form to an approximately S-shaped form to obtain appropriate linearity in the horizontal direction.

FIG. 19 is an explanation diagram showing display condition on the screen 20 with a horizontal deflection current IH having a sawtooth waveform. As shown in this diagram, when the sawtooth horizontal deflection current IH flows as shown in the graph G11, the amount of displacement, X, of the electron beam path 25 varies as shown in the graph G12 in the horizontal section of the display, e.g. a CRT.

At this time, the marginal areas of the screen 20 (the screen is rotated counterclockwise by 90°) are more distant from the deflection center than the intermediate areas, so that, if the variation of the amount of deflection current is constant, the electron beam is deflected larger in the marginal areas than in the intermediate areas. Accordingly, the interval ΔB between the vertical lines (horizontal lines in the diagram) in the marginal areas of the screen is larger than the interval ΔA between the vertical lines in the intermediate areas of the screen (i.e. ΔA<ΔB).

FIG. 20 is an explanation diagram showing display condition on the screen 20 with a horizontal deflection current IH having an S-shape-corrected sawtooth waveform. In order to correct the horizontal linearity shown in FIG. 19, the sawtooth horizontal deflection current IH shown in the graph G11 of FIG. 19 is modulated into an approximately S-shaped form as shown in the graph G21 in FIG. 20.

When the horizontal deflection current IH is modulated into such approximately S-shaped form, the S-shaped current provides a larger amount of current than the sawtooth current in the intermediate areas and therefore the lack of deflection in the intermediate areas of the screen can be compensated for as shown in the graph G22 of FIG. 20. An at the ends of the Y axis. While the combined inductance Ls is determined by the difference between the amounts of variations of the two coils' inductances L1 and L2 from those at the ends of the Y axis, it is usually equal to or smaller than those at the ends of the Y axis.

As shown in FIG. 10, the condition in the display position TR (in the upper right corner of the screen) or the display position BR (in the lower right corner of the screen) can be regarded as overlap of the condition at the ends of the Y axis and that in the display position R. In this case, the horizontal correction coil L1 becomes closer to the saturation state than at the ends of the Y axis, so that the inductance L1 becomes smaller than at the ends of the Y axis; the saturation state of the horizontal correction coil L2 is further canceled than at the ends of the Y axis so that the inductance L2 becomes larger than at the ends of the Y axis. The combined inductance is equal to or smaller than those at the ends of the Y axis.

FIG. 11 is an explanation diagram showing the variations of the combined inductance of the horizontal correction coils with respect to the display positions on the screen. In this diagram, the vertical axis shows the combined inductance Ls and the horizontal axis shows the horizontal deflection current IH. In the two curves, the curve LC1 shows the variation of the combined inductance Ls corresponding to a lateral line in the top and bottom of the screen and the curve LC2 shows the variation of the combined inductance Ls corresponding to a lateral line in the middle area of the screen. The signs showing the display positions on the screen attached to the points on the graph are the same as those shown in FIG. 4.

As can be seen from FIG. 11, in the top and bottom of the screen, the combined inductance Ls is the largest at the end of the Y axis and it becomes smaller as it approaches the corners of the screen. In the middle area of the screen, the combined inductance Ls is appropriate horizontal linearity (i.e. ΔA=ΔB) can thus be obtained as shown in the screen 20 of FIG. 20 by appropriately controlling the approximately S-shaped waveform.

FIG. 21 is a circuit diagram showing an example of the circuit configuration of a horizontal deflection circuit having the S-correcting function. As shown in this diagram, the positive side of the power supply E0 is connected to a fly-back transformer 41 and its negative side is connected to the emitter of a horizontal output transistor Q1. The collector of the horizontal output transistor Q1 is connected to the primary side of the fly-back transformer 41 and its base receives a control pulse.

A diode D20, a capacitor C20, and a series connection of a horizontal deflection coil LH and an S-correction capacitor CS are connected in parallel to the horizontal output transistor Q1. A diode D21 is connected to the secondary side of the fly-back transformer 41 and rectifies a signal transformed by the fly-back transformer 41.

In this configuration, in order to modulate the horizontal deflection current into approximately S-shaped form, a pulse having the horizontal scanning periods (hereinafter simply referred to as "horizontal periods") is supplied to the base of the horizontal output transistor Q1, and the horizontal deflection coil LH and the S-correction capacitor CS series-connected thereto are made to resonate at a resonant frequency determined by the horizontal deflection coil LH and the capacitor C20, and then a parabolic voltage as shown in FIG. 22 appears at both ends of the S-correction capacitor CS. The amount of current becomes larger in the period where the voltage is high, i.e. in the scanning period in the intermediate part in the horizontal direction on the screen, and the sawtooth current is thus modulated into the approximately S-shaped horizontal deflection current IH.

<Intermediate Pincushion Distortion Correction with Vertical Modulation of S-correction>

For convenience of description, linearity where $\Delta A<\Delta B$ as shown in FIG. 19 is called outer-area expansion and linearity where $\Delta A>\Delta B$ is called inner-area expansion.

Considering the intermediate pincushion distortion from the viewpoint of the horizontal linearity, it is seen that the inner-area expansion occurs in the top and bottom areas of the screen and the outer-area expansion occurs in the middle area of the screen. The inner-area expansion can be regarded as excess of S-correction and the outer-area expansion can be regarded as lack of S-correction. Hence, the intermediate pincushion distortion can be corrected by making the amount of S-correction smaller in the top and bottom areas of the screen and larger in the middle area. That is to say, it can be corrected if the amount of S-correction can be appropriately varied in the vertical period.

<Structure of Conventional Image Distortion Correcting Circuit with S-correction Vertical Modulation Function>

FIG. 23 is a circuit diagram showing the structure of a conventional image distortion correcting circuit shown in Japanese Patent Application Laid-Open No. 11-261839 (1999), for example. As shown in this diagram, a horizontal deflection current IH flows between the terminal P1 and terminal P2, where a horizontal deflection coil 21, horizontal correction coil L13 and horizontal correction coil L14 are series-connected between the terminals P1 and P2. The horizontal correction coil L13 and the horizontal correction coil L14 are wound around the same core 13. The horizontal deflection coil 21 is shown as a block for convenience, since various internal configurations, such as a single coil, a parallel connection of coils, etc. are possible.

A vertical deflection current IV flows between the terminal P3 and the terminal P4, where a vertical deflection coil 22 is provided between the terminal P3 and intermediate terminal P11. The vertical deflection coil 22 is shown as a block for convenience, since various structures, such as a combinational circuit of a single coil, or a series connection of coils, and resistors for balance correction (including variable resistors), etc. are possible.

The intermediate point P11 is connected to the anode of a diode D7 and to one end of a resistor R4, and the cathode of the diode D7 is connected to one end of a vertical correction coil L15 and the cathode of a diode D8. The other end of the resistor R4 and one end of a resistor R5 are connected to the other end of the vertical correction coil L15 and the anode of the diode D8 and the other end of the resistor R5 are connected to the terminal P4. The vertical correction coil L15 is wound around the core 13.

The intermediate pincushion distortion correcting saturable reactor unit 10 includes the horizontal correction coils L13 and L14, vertical correction coil L15, magnets 11 and 12, and core 13; the magnets 11 and 12 are arranged at both ends of the core 13 so as to bias the magnetic field in one direction (to the left in FIG. 23). The winding directions of the horizontal correction coils L13 and L14 are set in opposite directions to each other so that they produce magnetic fields in opposite directions to each other, and the winding direction of the vertical correction coil L15 is set so that it produces a magnetic field in the direction opposite to the direction in which the magnets 11 and 12 bias.

In the intermediate pincushion distortion correcting saturable reactor unit 10 in this image distortion correcting circuit, the inductances of the horizontal correction coils L13 and L14 where the horizontal deflection current IH flows is controlled in accordance with the vertical deflection current IV flowing through the vertical correction coil L15, so that the amount of S-shape distortion correction in horizontal deflection varies according to the amount of vertical deflection.

That is to say, while the horizontal correction coils L13 and L14 are connected to one end of the horizontal deflection coil 21 and are modulated by the vertical deflection current IV which varies in the vertical period, the vertical correction coil L15 produces a magnetic field directed to cancel the bias magnetic field produced by the magnets 11 and 12, whereby the inductances of the horizontal correction coils L13 and L14 are varied to control the correction. At this time, the horizontal deflection current IH applied to the two horizontal correction coils L13 and L14 is an S-corrected sawtooth current given in each horizontal period, and the vertical deflection current IV applied to the vertical correction coil L15 is a current where a sawtooth current given in each vertical period is rectified to the same polarity through the two diodes D7 and D8 and the two resistors R4 and R5.

FIG. 24 is a schematic side view showing the main structure of the intermediate pincushion distortion correcting saturable reactor unit 10. As shown in this diagram, the three drum-like partial cores 13*a* to 13*c* accommodated in the case 39 are arranged adjacent to each other on the same axis; the horizontal correction coil L13 is wound around the partial core 13*a*, the vertical correction coil L15 is wound around the partial core 13*b*, and the horizontal correction coil L14 is wound around the partial core 13*c*.

The pair of magnets 11 and 12 are provided at the ends of the partial cores 13*a* to 13*c* with their polarities directed in the same direction. As stated above, the horizontal correction coils L13 and L14 are wound in opposite directions and the vertical correction coil L15 is wound in such a direction that, when a current is passed, a magnetic field is produced to cancel the magnetic field produced by the pair of magnets 11 and 12 (hereinafter referred to as bias magnetic field).

<Functions of the Conventional Device>

In the conventional image distortion correcting circuit constructed as shown in FIGS. 23 and 24, the magnetic field produced from the vertical correction coil L15 in the vertical period cancels the bias magnetic field from the magnets 11 and 12, so that the inductances of the horizontal correction coils L13 and L14 vary. That is to say, the bias magnetic field is canceled in the top and bottom areas of the screen and therefore the combined inductance of the horizontal correction coils L13 and L14 becomes larger; the bias magnetic field remains in the middle area of the screen and therefore the combined inductance of the horizontal correction coils L13 and L14 becomes smaller.

By the way, the voltage waveform at both ends of the S-correction capacitor CS in the horizontal period is considered to be part of the sine wave caused by series resonance of the horizontal deflection coil 21, horizontal correction coils L13 and L14 and S-correction capacitor CS, so that its resonant angular frequency $\omega s$ is given as shown by the equation (1) below:

$$\omega s=1/\sqrt{(Lh+Ls)\cdot Cs} \quad (1)$$

Where Lh is the inductance of the horizontal deflection coil 21, Ls is the combined inductance of the horizontal correction coils L13 and L14, and Cs is the capacitance of the S-correction capacitor CS.

It is seen from equation (1) that the resonant angular frequency $\omega s$ becomes smaller as the combined inductance Ls of the horizontal correction coils becomes larger, and then the parabolic voltage waveform becomes flatter and the effect of S-correction becomes weaker. When the combined inductance Ls of the horizontal correction coils becomes smaller, the effect of S-correction becomes stronger.

Thus, in the image distortion correcting circuit shown in FIGS. 23 and 24, the combined inductance Ls of the horizontal correction coils becomes larger in the top and bottom areas of the screen and therefore the effect of S-correction becomes weaker to cause outer-area expansion. In the middle area of the screen, the combined inductance Ls of the horizontal correction coils becomes smaller and therefore the effect of S-correction becomes stronger to cause inner-area expansion. The intermediate pincushion distortion can thus be corrected.

As shown in FIG. 24, the conventional image distortion correcting circuit uses three partial cores 13*a* to 13*c* to realize the core 13 in the intermediate pincushion distortion correcting saturable reactor unit 10, which leads to increased cost and complicated manufacturing process.

The conventional image distortion correcting circuit has other problems like the following Since the entire system including the core 13 and magnets 11 and 12 does not form a closed magnetic circuit, magnetic leakage occurs at low level. Since the vertical correction coil is rectified by diodes, the vertical deflection sensitivity is deteriorated by the resistance components of the diodes and the consumption power is increased.

SUMMARY OF THE INVENTION

A first aspect of the present invention is directed to an image distortion correcting device comprising first and second horizontal correction coils provided on a horizontal deflection current path through which a horizontal deflection current flows, the first and second horizontal correction coils being connected in series and wound around a core in such directions that the first and second horizontal correction coils produce magnetic fields in opposite directions to each other; magnetic field biasing means for biasing the magnetic fields in a first direction; and a vertical correction coil provided on a vertical deflection current path through which a vertical deflection current flows, for producing a magnetic field in a second direction opposite to the first direction, wherein the vertical correction coil is wound over the first and second horizontal correction coils along the periphery of windings thereof.

Preferably, according to a second aspect, in the image distortion correcting device, the core includes first and second partial cores, and the first and second horizontal correction coils include coils wound around the first and second partial cores, respectively.

Preferably, according to a third aspect, in the image distortion correcting device, the core includes an integral single-unit core, and the first and second horizontal correction coils include coils wound in first and second regions of the integral core, respectively.

Preferably, according to a fourth aspect, in the image distortion correcting device, the magnetic field biasing means includes first and second magnets provided at both ends of the core, with their polarities directed in the same direction.

Preferably, according to a fifth aspect, in the image distortion correcting device, the magnetic field biasing means includes a single-unit magnet provided between the first and second partial cores.

Preferably, according to a sixth aspect, the image distortion correcting device further comprises a magnetically closing member connected to at least one of the magnetic field biasing means and the core, for forming a closed magnetic circuit together with the magnetic field biasing means and the core.

Preferably, according to a seventh aspect, in the image distortion correcting device, the magnetically closing member includes a yoke plate arranged to be magnetically coupled with the magnetic field biasing means or the core.

Preferably, according to an eighth aspect, in the image distortion correcting device, the vertical correction coil includes first and second vertical correction coils, the first vertical correction coil produces a magnetic field in the second direction when the vertical deflection current having a first polarity flows, and the second vertical correction coil produces a magnetic field in the second direction when the vertical deflection current having a second polarity flows opposite to the first polarity flows, and the first and second vertical correction coils include coils wound concurrently over the periphery of the first and second horizontal correction coils.

Preferably, according to a ninth aspect, the image distortion correcting device further comprises an insulating bobbin provided along the periphery of windings of the first and second horizontal correction coils, and the vertical correction coil includes a coil wound around the bobbin.

Preferably, according to a tenth aspect, in the image distortion correcting device, the vertical correction coil includes coils wound approximately the same number of turns in first and second peripheral regions respectively corresponding to the first and second horizontal correction coils.

Preferably, according to an eleventh aspect, the image distortion correcting device further comprises an insulating bobbin provided along the periphery of windings of the first and second horizontal correction coils, and the bobbin has a collar in a position corresponding to a middle position between the first and second horizontal correction coils.

Preferably, according to a twelfth aspect, in the image distortion correcting device, at least one of the first and second horizontal correction coils and the vertical correction coil includes a coil using assembled stranded wire as its winding.

As stated above, in the image distortion correcting device of the first aspect of the invention, the vertical correction coil is wound over the first and second horizontal correction coils along the periphery of the windings of them. Therefore no separate core is required for the winding of the vertical correction coil and the cost of the device can thus be reduced.

Furthermore, since the vertical correction coil is wound over the periphery of the first and second horizontal correction coils, wire having a relatively large diameter can be used as the vertical correction coil so as to reduce its resistance component, thus reducing the consumption power of the vertical correction coil.

According to the image distortion correcting device of the second aspect, the first and second horizontal correction coils are wound separately around the first and second partial cores. Accordingly the mutual inductance of the two can be set low relatively easily.

According to the image distortion correcting device of the third aspect, the first and second horizontal correction coils are wound around an integral single-unit core. The use of one integral core for two horizontal correction coils reduces the device cost.

In addition, the first and second horizontal correction coils are free from misalignment of the axes since they are wound around a common integral core.

According to the image distortion correcting device of the fourth aspect, the first and second magnets provided at both ends of the core effectively exert a magnetic field in the first direction between them.

According to the image distortion correcting device of the fifth aspect, a single-unit magnet is provided between the first and second partial cores to produce a magnetic field in the first direction, so that the device cost can be reduced as compared with a structure using a plurality of units of magnets.

Furthermore, in contrast to a device where magnets are arranged at both ends of a core including first and second partial cores, the wire of the first and second horizontal correction coils wound around the first and second partial cores can be easily drawn out, which enhances the efficiency of the device manufacture.

According to the image distortion correcting device of the sixth aspect, the magnetically closing member forms a closed magnetic circuit together with the magnetic field biasing means and the core, so that the magnetic leakage can be effectively prevented.

According to the image distortion correcting device of the seventh aspect, the magnetic force of the magnetic field biasing means or the vertical correction coil can be enhanced by the magnetic coupling of the yoke plate. Therefore the magnetic field biasing means can be reduced in size to reduce the device cost, or the number of turns of the vertical correction coil can be reduced to reduce the consumption power.

According to the image distortion correcting device of the eighth aspect, the first and second vertical correction coils are wound concurrently and the efficiency of the winding work can be thus enhanced. Further, it is possible to reduce variation in resistance component between the first and second vertical correction coils, since the first and second vertical correction coils are wound in almost the same paths.

According to the image distortion correcting device of the ninth aspect, the insulating bobbin present between the first and second horizontal correction coils and the vertical correction coil effectively prevents short-circuit between the first and second horizontal correction coils and the vertical correction coil.

According to the image distortion correcting device of the tenth aspect, the vertical correction coils are wound approximately the same number of turns in the first and second peripheral regions respectively corresponding to the first and second horizontal correction coils. This suppresses occurrence of cross-talk current between the first and second horizontal correction coils and the vertical correction coil, thus reducing the amount of generated heat and increasing the amount of correction to the intermediate pincushion distortion.

According to the image distortion correcting device of the eleventh aspect, the collar formed halfway on the bobbin allows the vertical correction coil to be easily divided into two partial coils wound approximately the same number of turns in the first and second peripheral regions.

According to the image distortion correcting device of the twelfth aspect, at least one of the first and second horizontal correction coils and the vertical correction coil is made of assembled stranded wire as the winding. This suppresses an increase in alternating-current resistance due to skin effect to reduce the amount of generated heat.

The present invention has been made to solve the aforementioned problems, and an object of the present invention is to obtain an image distortion correcting device with reduced cost and lower consumption power.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

<Circuit Configuration>

Figure 1:
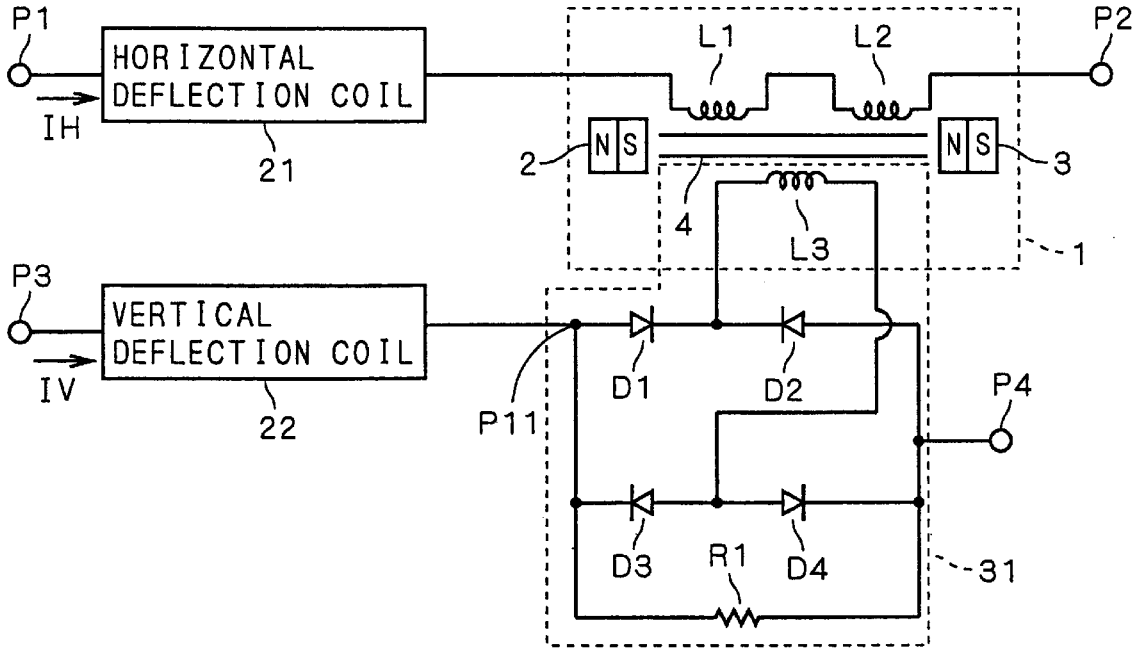
FIG. 1 is a circuit diagram showing the circuit configuration of an image distortion correcting device according to a first preferred embodiment of the invention.

FIG. 1 is a circuit diagram showing the circuit configuration of an image distortion correcting device according to a first preferred embodiment of the invention.

As shown in this diagram, a horizontal deflection current IH flows in the horizontal deflection current path between a terminal P1 and a terminal P2, where a horizontal deflection coil 21, a horizontal correction coil L1 and a horizontal correction coil L2 are series-connected between the terminals P1 and P2. The horizontal correction coil L1 and the horizontal correction coil L2 are wound around a core 4.

A vertical deflection current IV flows in the vertical deflection current path between a terminal P3 and a terminal P4, where a vertical deflection coil 22 is provided between the terminal P3 and an intermediate terminal P11.

Provided between the intermediate terminal P11 and the terminal P4 is a vertical correction unit 31 including a vertical correction coil L3, diodes D1 to D4 and a resistor R1. The internal structure of the vertical correction unit 31 is now described. The anode of the diode D1, the cathode of the diode D3, and one end of the resistor R1 are connected to the intermediate terminal P11, and one end of the vertical correction coil L3 and the cathode of the diode D2 are connected to the cathode of the diode D1. The anodes of the diodes D3 and D4 are connected to the other end of the vertical correction coil L3, and the anode of the diode D2, the cathode of the diode D4 and the other end of the resistor R1 are connected to the terminal P4.

That is to say, a first current path (the path in which the diodes D1, D4 and the vertical correction coil L3 are connected in series) and a second current path (the path in which the diodes D2 and D3 and the vertical correction coil L3 are connected in series) are provided between the intermediate terminal P11 and the terminal P4 and are connected in common in parallel to the common resistor R1.

While the circuit structure shown in FIG. 1 uses diode bridge of the diodes D1 to D4 and the resistor R3 to pass a rectified vertical deflection current to the vertical correction coil L3, other rectifier circuitry may be used.

<Structure of Intermediate Pincushion Distortion Correcting Saturable Reactor Unit>

Figure 2:
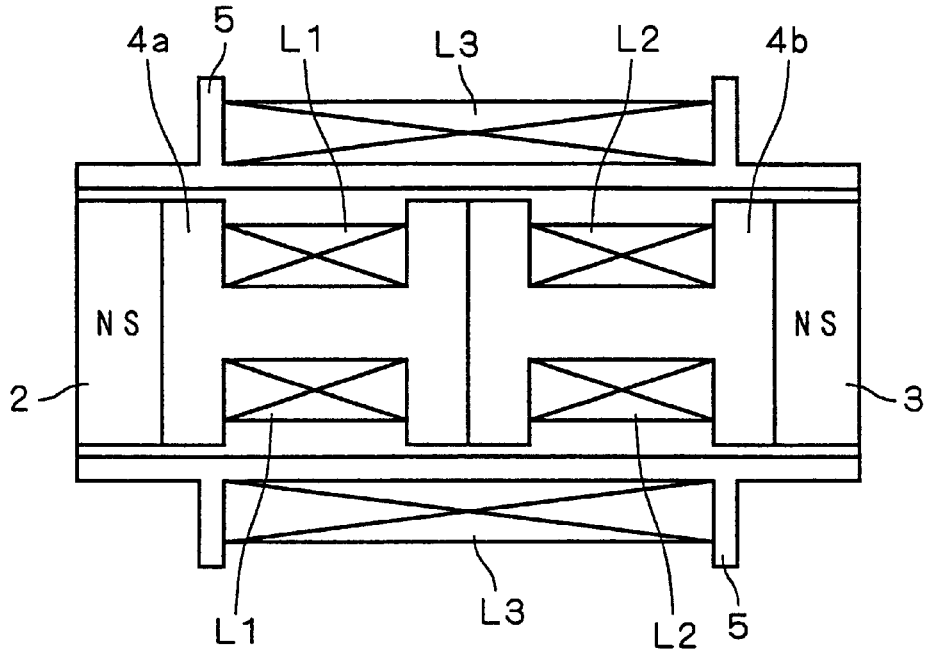
FIG. 2 is a sectional view showing the structure of the intermediate pincushion distortion correcting saturable reactor unit in the image distortion correcting device shown in FIG. 1.

FIG. 2 is a sectional view showing the structure of the intermediate pincushion distortion correcting saturable reactor unit in the image distortion correcting device shown in FIG. 1. As shown in this diagram, the core 4 is composed of partial cores 4*a* and 4*b*; the partial cores 4*a* and 4*b* are coaxially arranged in contact so that they are magnetically coupled. Magnets 2 and 3 are arranged at both ends thereof; the magnets 2 and 3 are arranged in the same direction so that the S pole of the magnet 2 and the N pole of the magnet 3 are in contact with the core 4.

The horizontal correction coil L1 is wound around the partial core 4*a* and the horizontal correction coil L2 is wound around the partial core 4*b*. The numbers of turns of the two horizontal correction coils L1 and L2 are set approximately equal. For the winding directions, the horizontal correction coils L1 and L2 are wound in such directions that they produce magnetic fields in opposite directions to each other, and they are spaced at such a distance that the mutual inductance of the horizontal correction coils L1 and L2 is at negligible level. Since the horizontal correction coils L1 and L2 are thus wound around the separate partial cores 4*a* and 4*b*, they can be relatively easily arranged so that the mutual inductance is restricted low. The horizontal correction coil L1 and the horizontal correction coil L2 are connected in series as shown in FIG. 1.

A bobbin 5, for example, in cylindrical form, covers the partial cores 4*a* and 4*b* and the magnets 2 and 3 along the winding directions of the horizontal correction coils L1 and L2; the bobbin 5 has an insulating property. The vertical correction coil L3 is wound on the bobbin 5 around the partial cores 4*a* and 4*b*; it is wound along the windings of the horizontal correction coils L1 and L2. That is to say, the vertical correction coil L3 is wound over the horizontal correction coils L1 and L2 with the bobbin 5 interposed therebetween, along the periphery of the windings of the horizontal correction coils L1 and L2. The vertical correction coil L3 is wound in such a direction that it produces a magnetic field directed to cancel the bias magnetic field produced by the magnets 2 and 3.

In this way, the intermediate pincushion distortion correcting saturable reactor unit 1 shown in FIG. 1 corresponds to an equivalent circuit of the intermediate pincushion distortion correcting saturable reactor unit 1 shown in FIG. 2. As will be fully described below, intermediate pincushion distortion occurring in the right and left sides of the screen can be corrected by using this intermediate pincushion distortion correcting saturable reactor unit 1.

The image distortion correcting device of the first preferred embodiment is characterized in that the vertical correction coil L3 is wound over the horizontal correction coils L1 and L2 in the intermediate pincushion distortion correcting saturable reactor unit 1.

<Operation>

As described above, in the image distortion correcting device of the first preferred embodiment, the intermediate pincushion distortion correcting saturable reactor unit 1 and the rectifier circuit for the vertical deflection current in the vertical correction unit 31 form an image distortion correcting circuit. The operation of the image distortion correcting device of the first preferred embodiment is now described.

Figure 3:
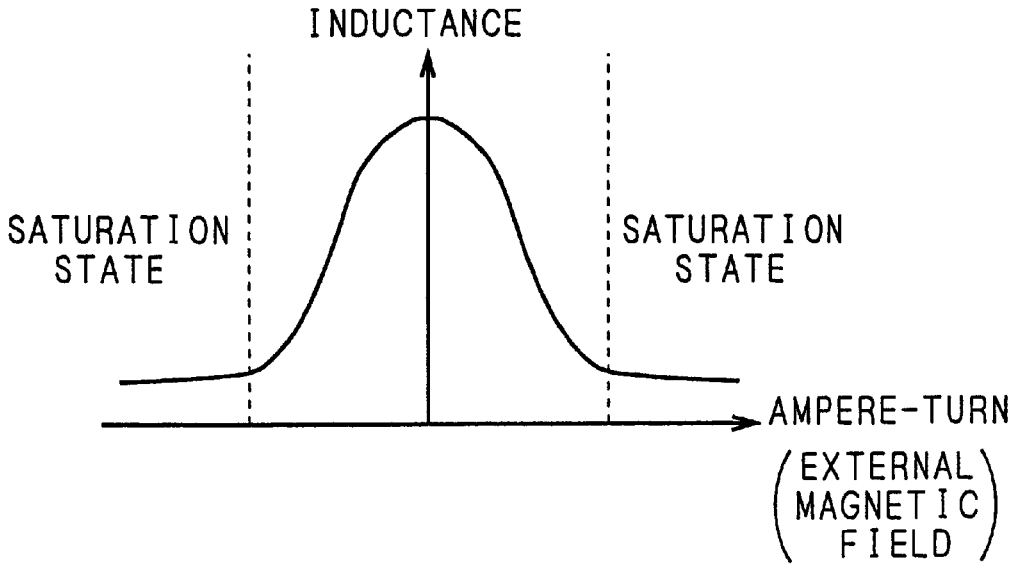
FIG. 3 is a graph showing inductance versus ampere-turn characteristic of a horizontal correction coil.

FIG. 3 is a graph showing the inductance versus ampere-turn characteristic of the horizontal correcting coils. In FIG. 3, the vertical axis shows the inductance of the horizontal correction coil and the horizontal axis shows the ampere-turn or external magnetic field. As shown in this diagram, the inductance of the horizontal correction coil is large when the ampere-turn is small and it becomes smaller as the ampere-turn becomes larger, and it then takes an approximately constant small value when the ampere-turn reaches a certain value or higher (saturation state).

Since the two horizontal correction coils L1 and L2 are arranged so that the mutual inductance is at negligible level, the combined inductance Ls of the two horizontal correction coils L1 and L2 is given by the sum total of the inductance L1 and the inductance L2 of the coils. That is, "Ls=L1 +L2."

Figure 4:
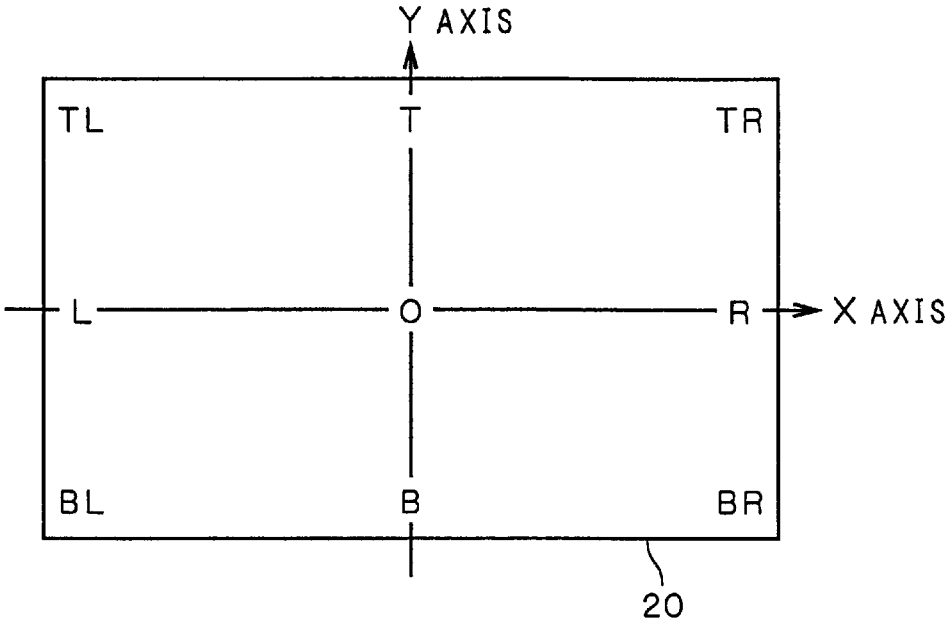
FIG. 4 is an explanation diagram showing the correspondence between signs attached to display positions and actual display positions on the screen.

Variation of the combined inductance Ls of the horizontal correction coils is now described in correspondence with display positions on the screen. FIG. 4 shows the correspondence between the signs of display positions and actual display positions on the screen. In this diagram, the horizontal axis of the screen is taken as X axis and the vertical axis is taken as Y axis.

The horizontal deflection current IH applied to the two horizontal correction coils L1 and L2 is an S-corrected sawtooth current given in each horizontal period and the vertical deflection current IV applied to the vertical correction coil L3 is a sawtooth current given in each vertical period which is rectified to the same polarity by the four diodes D1 to D4 and one resistor R1.

Figure 5:
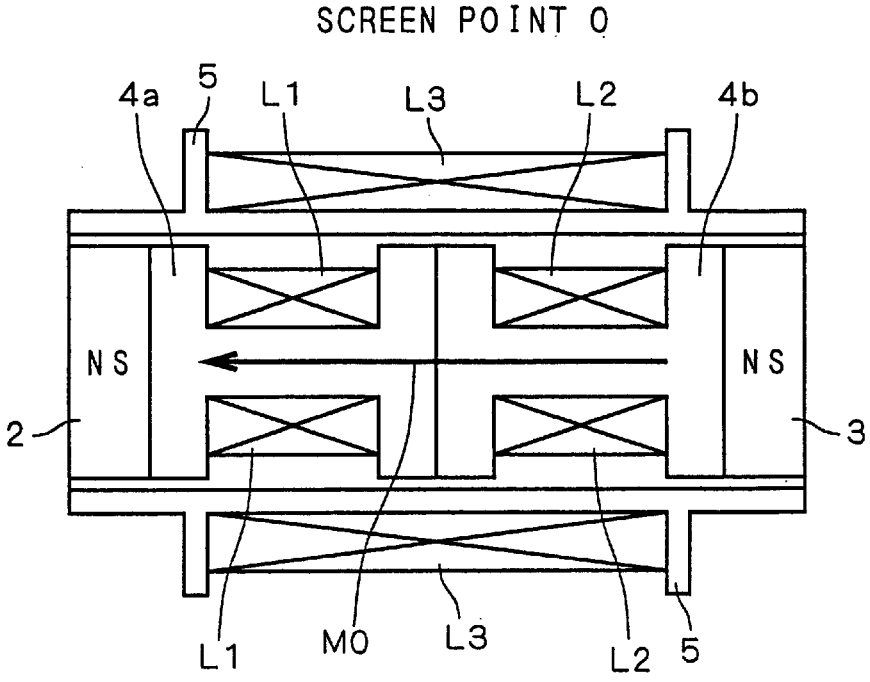
FIG. 5 is an explanation diagram showing the magnetic field in the intermediate pincushion distortion correcting saturable reactor unit in the center of the screen.

As shown in FIG. 5, in the display position O (in the center of the screen), current does not flow to any of the horizontal correction coils L1 and L2 and the vertical correction coil L3. Accordingly the magnetic field acting on the horizontal correction coils L1 and L2 is only the bias magnetic field M0 produced by the magnets 2 and 3. The horizontal correction coils L1 and L2 are both set to be in saturation state at this time and the combined inductance Ls is small.

Figure 6:
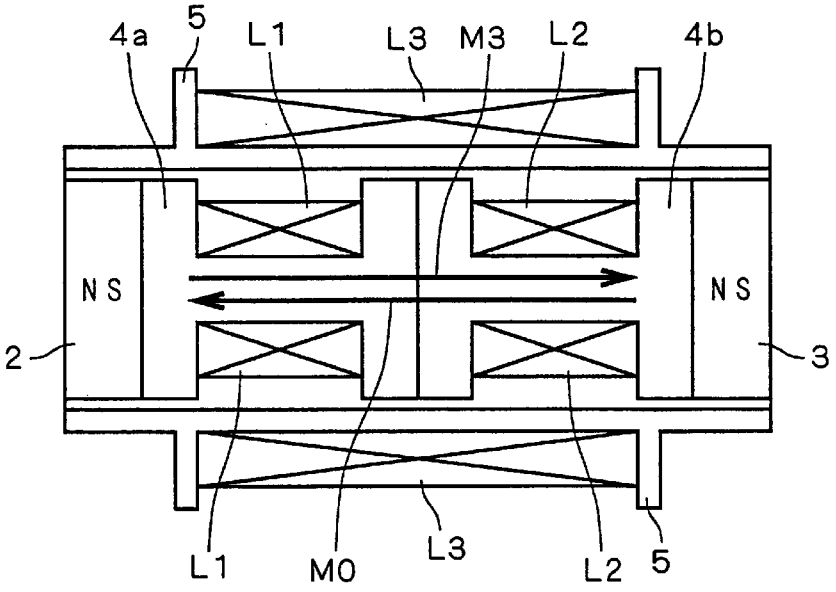
FIG. 6 is an explanation diagram showing the magnetic field in the intermediate pincushion distortion correcting saturable reactor unit in the top and bottom of the screen.

As shown in FIG. 6, in the display position T (at the upper end of the Y axis) or in the display position B (at the lower end of the Y axis), no current flows through the horizontal correction coils L1 and L2 and a current flows only through the vertical correction coil L3. The magnetic field M3 produced by the vertical correction coil L3 cancels the bias magnetic field M0 of the magnets 2 and 3 and therefore the saturation state of the horizontal correction coils L1 and L2 is canceled. Accordingly the inductances of the horizontal correction coils L1 and L2 become larger and therefore their combined inductance Ls becomes larger.

Figure 7:
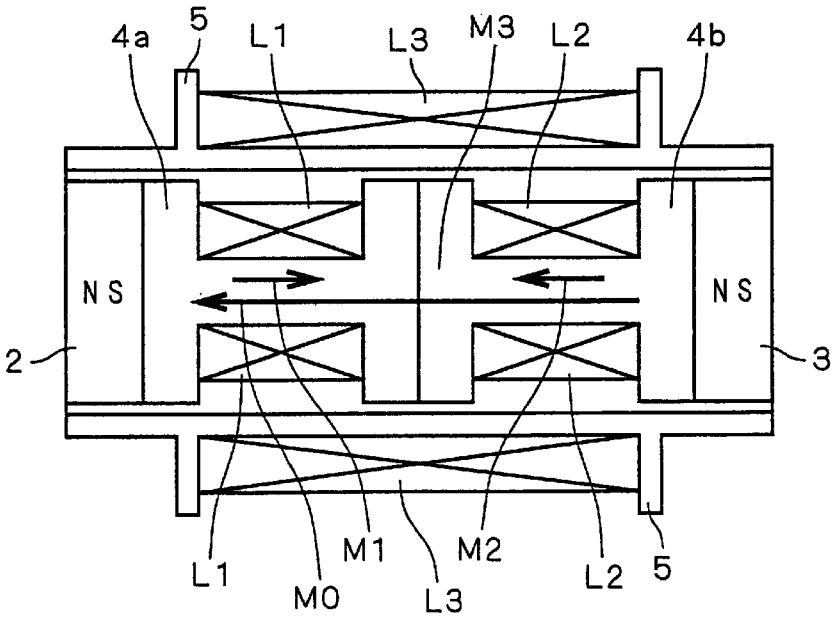
FIG. 7 is an explanation diagram showing the magnetic field in the intermediate pincushion distortion correcting saturable reactor unit in the left of the screen.

As shown in FIG. 7, in the display position L (at the left end of the X axis), a current flows through the horizontal correction coils L1 and L2 and no current flows through the vertical correction coil. In this case, the magnetic field M1 produced by the horizontal correction coil L1 is directed so as to cancel the bias magnetic field M0 of the magnets 2 and 3, so that the saturation state of the horizontal correction coil L1 is canceled and the inductance L1 becomes larger. The magnetic field M2 produced by the horizontal correction coil L2 is in the same direction as the bias magnetic field M0 of the magnets 2 and 3, so that the horizontal correction coil L2 stays in the saturation state and the inductance L2 is small. Hence the combined inductance Ls becomes larger by the increase of L1.

Figure 8:
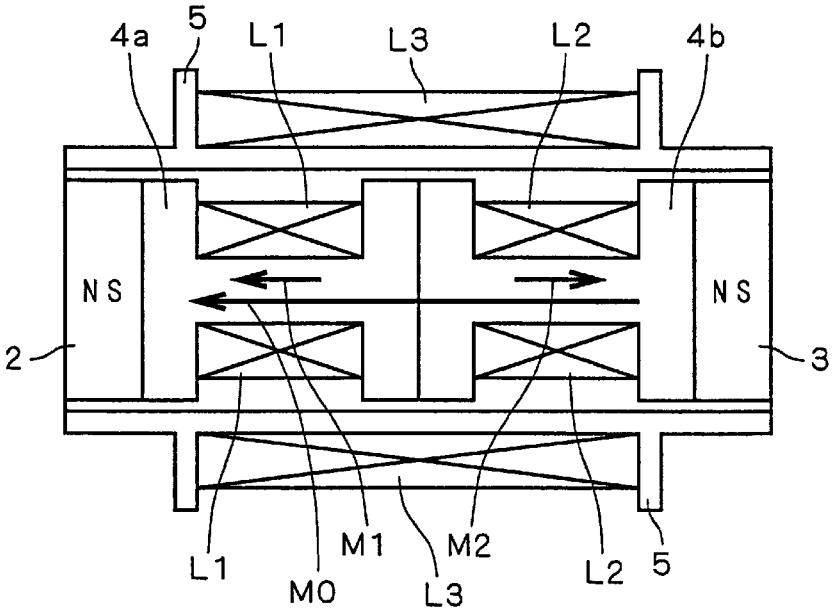
FIG. 8 is an explanation diagram showing the magnetic field in the intermediate pincushion distortion correcting saturable reactor unit in the right of the screen.

As shown in FIG. 8, the display position R (at the right end of the X axis) is in the reverse condition to the display position L, where the horizontal correction coil L1 stays in the saturation state and the inductance is small; the saturation state of the horizontal correction coil L2 is canceled and the inductance L2 becomes larger. The combined inductance therefore becomes larger by the increase of L2.

Figure 9:
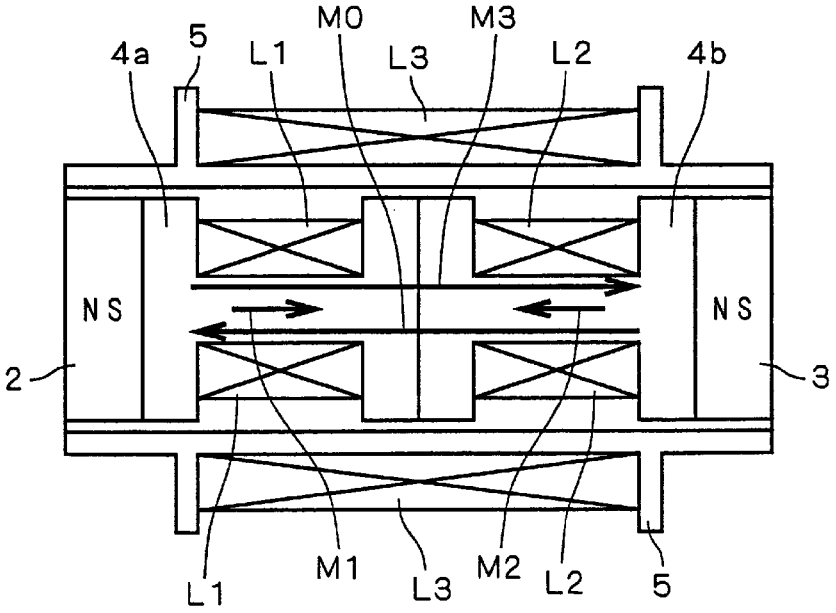
FIG. 9 is an explanation diagram showing the magnetic field in the intermediate pincushion distortion correcting saturable reactor unit in the upper left and lower left corners of the screen.
Figure 10:
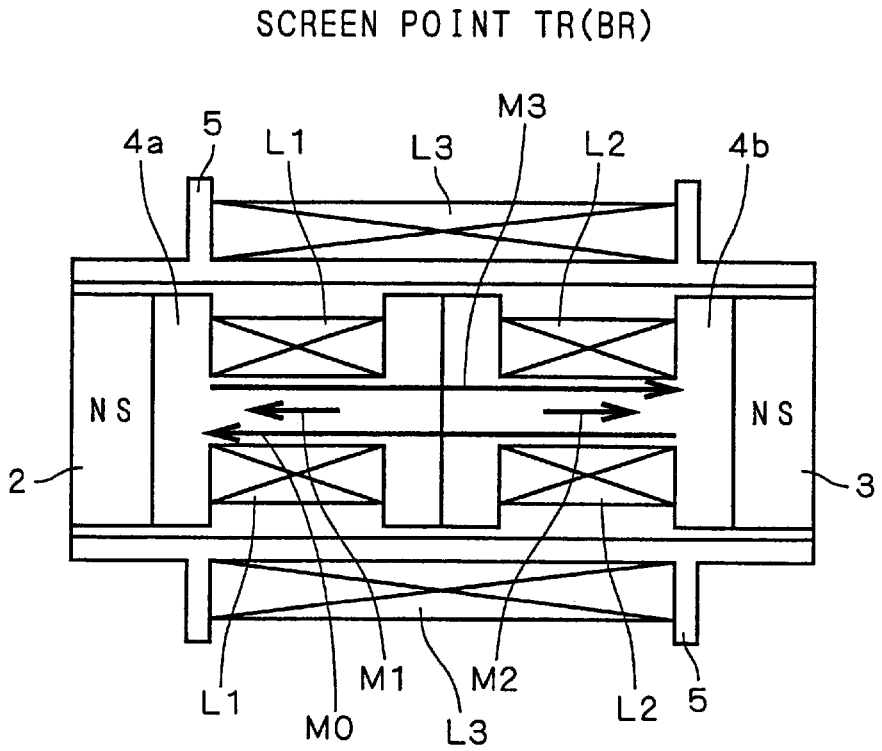
FIG. 10 is an explanation diagram showing the magnetic field in the intermediate pincushion distortion correcting saturable reactor unit in the upper right and lower right corners of the screen.
Figure 11:
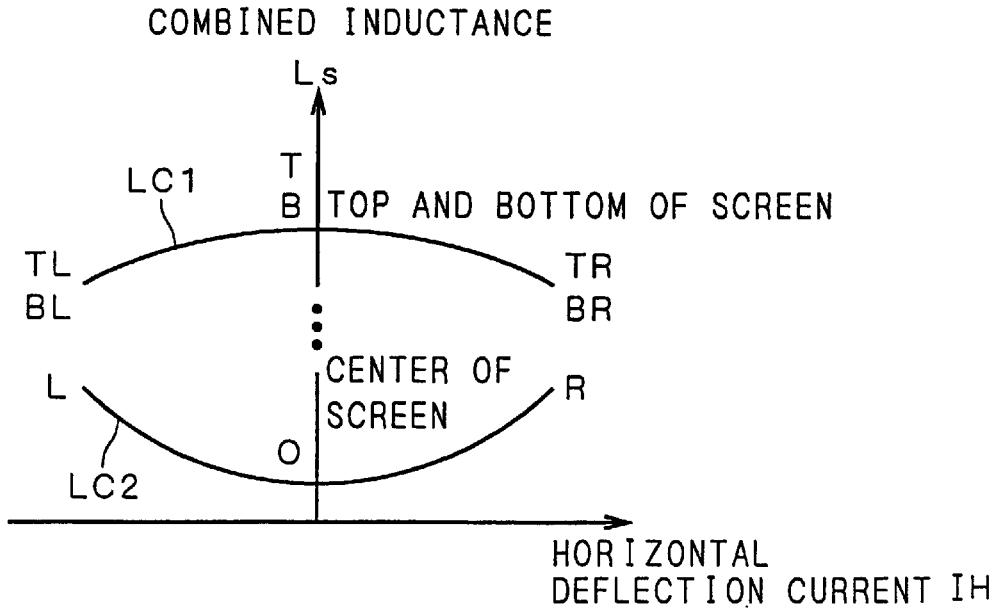
FIG. 11 is an explanation diagram showing variations of the combined inductance of the horizontal correction coils with respect to the display positions on the screen.

As shown in FIG. 9, the conditions in the display position TL (in the upper left corner of the screen) and the display position BL (in the lower left corner of the screen) can be regarded as overlap of the condition in the display position T or the display position B (hereinafter referred to as the ends of the Y axis) and that in the display position L. In this case, since the magnetic field Ml produced by the horizontal correction coil L1 and the magnetic field M3 produced by the vertical coil L3 are in the same direction, the saturation state of the horizontal correction coil L1 is further canceled than at the ends of the Y axis. Accordingly the inductance L1 of the horizontal correction coil L1 becomes larger than at the ends of the Y axis. On the other hand, the magnetic field M2 produced by the horizontal correction coil L2 is in the opposite direction to the magnetic field M3 produced by the vertical coil L3, so it comes closer to the saturation state than at the ends of the Y axis. Hence the inductance L2 of the horizontal correction coil L2 becomes smaller than the smallest in the center of the screen and becomes larger as it approaches the ends of the X axis.

Thus, the combined inductance Ls of the horizontal correction coils is larger in the top and bottom of the screen and it is smaller in the middle area of the screen, so that the amount of S-correction can be smaller in the top and bottom of the screen and larger in the middle area of the screen, whereby the intermediate pincushion distortion can be corrected.

Furthermore, the variation of the combined inductance Ls with respect to the horizontal deflection current IH increases the effect of intermediate pincushion distortion correction. That is to say, in the top and bottom of the screen, the combined inductance Ls of the horizontal correction coils is large in the middle of the horizontal direction and becomes smaller in areas near the sides, so that the amplitude in the horizontal direction relatively shrinks in the center area and expands in the side areas (that is, outer-area expansion).

In the middle area of the screen, the combined inductance Ls of the horizontal correction coils is small in the center of the horizontal direction and becomes larger in the side areas, so that the amplitude in the horizontal direction relatively expands in the center and shrinks in the side areas (that is, inner-area expansion).

Furthermore, in the image distortion correcting device of the first preferred embodiment, only two partial cores (4*a* and 4*b* ) are used in the intermediate pincushion distortion correcting saturable reactor unit 1, so that the device cost can be reduced as compared with the conventional example where three partial cores are used.

Moreover, since the vertical correction coil L3 is would around the bobbin 5, sufficient winding intervals can be taken as compared with those in the conventional device where it is wound on the small core 13, so that a wire having a larger line diameter and smaller resistivity can be used as the winding of the vertical correction coil L3, which reduces the consumption power of the vertical correction coil L3.

Further, the horizontal correction coils L1 and L2 and the vertical correction coil L3 are insulated by the insulating bobbin 5 interposed between them, which sufficiently prevents problems like short-circuit between the horizontal correction coils L1 and L2 and the vertical correction coil L3.

The vertical correction coil L3 may be wound directly on the horizontal correction coils L1 and L2 if the windings of the horizontal correction coils L1 and L2 and the vertical correction coil L3 are sufficiently insulated.

Second Preferred Embodiment

Figure 12:
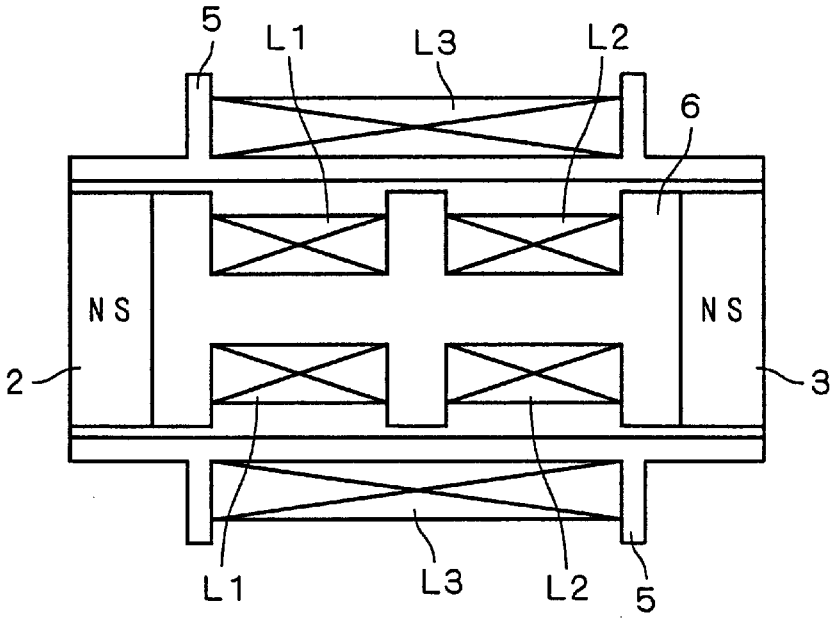
FIG. 12 is a sectional view showing the structure of the intermediate pincushion distortion correcting saturable reactor unit in an image distortion correcting device according to a second preferred embodiment of the invention.

FIG. 12 is a sectional view showing the structure of an intermediate pincushion distortion correcting saturable reactor unit in an image distortion correcting device according to a second preferred embodiment of the invention. The circuit configuration is the same as that of the image distortion correcting circuit shown in FIG. 1 in the first preferred embodiment.

As shown in this diagram, the core 4 of FIG. 1 is formed of an integral single-unit core 6. The horizontal correction coil L1 is wound around the core 6 in the region on the side of the magnet 2 and the horizontal correction coil L2 is wound in the region on the side of the magnet 3. In other respects, the structure is the same as that of FIG. 2 of the first preferred embodiment.

The image distortion correcting device thus constructed according to the second preferred embodiment can operate in the same way as the image distortion correcting device of the first preferred embodiment. Further, the structure of the second preferred embodiment using the single-unit core 6 in place of the two-unit partial cores 4 of the first preferred embodiment uses a reduced number of parts and a reduced number of assembling steps, leading to cost reduction of the device. Moreover, unlike a device using two partial cores as in the first preferred embodiment, this device is free from misalignment of the axes.

Third Preferred Embodiment

Figure 13:
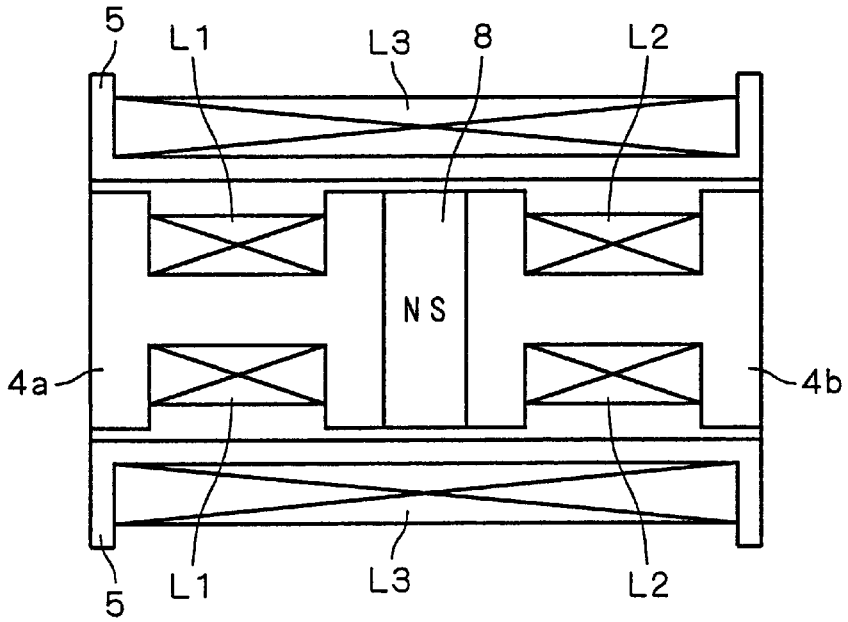
FIG. 13 is a sectional view showing the structure of the intermediate pincushion distortion correcting saturable reactor unit in an image distortion correcting device according to a third preferred embodiment of the invention.

FIG. 13 is a sectional view showing the structure of an intermediate pincushion distortion correcting saturable reactor unit in an image distortion correcting device according to a third preferred embodiment of the invention. The circuit configuration is the same as that of the image distortion correcting circuit shown in FIG. 1 in the first preferred embodiment, except the magnet arrangement.

As shown in this diagram, a single magnet 8 is provided between the partial cores 4*a* and 4*b*, in place of the magnets 2 and 3. The magnet 8 is set so that it produces the same bias magnetic field as that produced by the magnets 2 and 3. In other respects the structure is the same as that shown in FIG. 2 in the first preferred embodiment.

The image distortion correcting device thus constructed in the third preferred embodiment can operate in the same way as the image distortion correcting device of the first preferred embodiment. Further, as compared with the first and second preferred embodiments using two units of magnets 2 and 3, the number of parts can be reduced in the structure of the third preferred embodiment using a single-unit magnet 8 and therefore the cost of the device can be reduced.

Moreover, unlike the first and second preferred embodiments where the magnets 2 and 3 are arranged at both ends of the cores (4*a*, 4*b*; 6), the wire of the horizontal correction coils L1 and L2 can be smoothly drawn out from the bobbin 5 without being interfered by the magnet, which enhances the efficiency of the device manufacture. In addition, it is not necessary to form a groove etc. on the bobbin 5 to draw out the wire, and the structure of the bobbin 5 can be thus simplified.

fourth Preferred Embodiment

Figure 14:
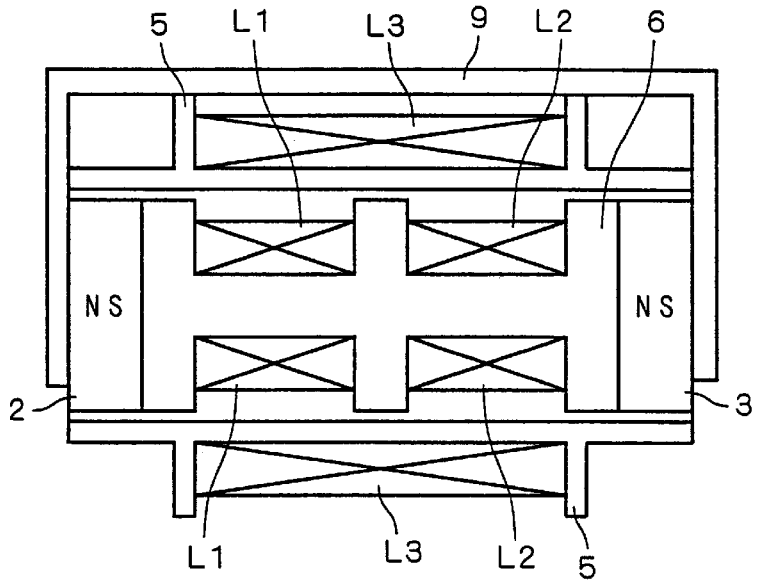
FIG. 14 is a sectional view showing the structure of the intermediate pincushion distortion correcting saturable reactor unit in an image distortion correcting device according to a fourth preferred embodiment of the invention.

FIG. 14 is a sectional view showing the structure of an intermediate pincushion distortion correcting saturable reactor unit in an image distortion correcting device according to a fourth preferred embodiment of the invention. The circuit configuration is the same as that of the image distortion correcting circuit shown in FIG. 1 in the first preferred embodiment.

As shown in this diagram, an approximately U-shaped yoke plate 9, as a member for closing the magnetic circuit, partially covers the bobbin 5. The yoke plate 9 is made of a low-priced material such as a silicon steel plate etc., both sides of which are proximate to the ends of the right and left magnets 2 and 3; the core 6 -magnets 2, 3-yoke plate 9 integrally form a closed magnetic circuit. In other respects the structure is the same as that shown in FIG. 12 in the second preferred embodiment.

The yoke plate 9 may be provided on the intermediate pincushion distortion correcting saturable reactor unit shown in the above-described first or third preferred embodiment. When the yoke plate 9 is provided in the structure of the third preferred embodiment, the sides of the yoke plate 9 are set proximate to the ends of the partial cores 4*a* and 4*b*. That is to say, the yoke plate 9 magnetically couples with the magnets 2, 3 or the partial cores 4*a* and 4*b* to form a closed magnetic circuit.

In the image distortion correcting device thus constructed in the third preferred embodiment, the yoke plate 9 increases the magnetic flux density produced by the magnets 2 and 3, so that thinner magnets can be used as the magnets 2 and 3, which enables cost reduction and size reduction of the device.

Moreover, the yoke plate 9 reduces the reluctance and thus increases the efficiency of the vertical correction coil L3, whereby the number of turns of the coil can be reduced. This enables cost reduction and consumption power reduction of the device. Furthermore, magnetic leakage can be effectively suppressed since the entirety forms a closed magnetic circuit.

Fifth Preferred Embodiment

Figure 15:
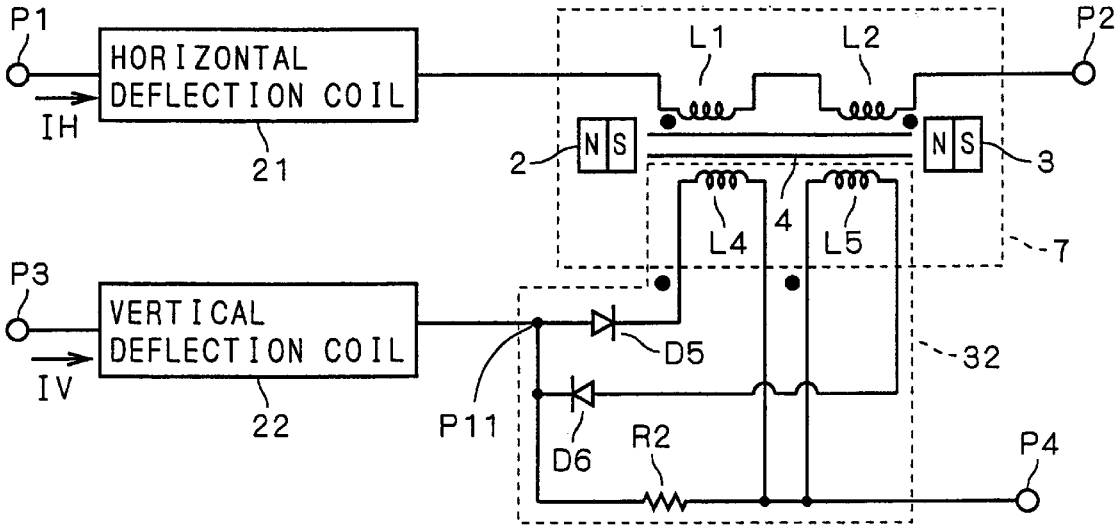
FIG. 15 is a circuit diagram showing the circuit configuration of an image distortion correcting device according to a fifth preferred embodiment of the invention.

FIG. 15 is a circuit diagram showing the circuit structure of an image distortion correcting device according to a fifth preferred embodiment of the invention.

As shown in this diagram, a vertical correction unit 32 including vertical correction coils L4 and L5, diodes D5 and D6, and resistor R2 is provided between the intermediate terminal P11 and the terminal P4. The internal structure of the vertical correction unit 32 is now described. The anode of the diode D5, the cathode of the diode D6 and one end of the resistor R2 are connected to the intermediate terminal P11. One end of the vertical correction coil L4 is connected to the cathode of the diode D5 and the other end of the resistor R2 and the terminal P4 are connected to the other end of the vertical correction coil L4. One end of the vertical correction coil L5 is connected to the terminal P4 and the other end of the vertical correction coil L5 is connected to the anode of the diode D6. In other respects the circuit configuration is the same as that shown in FIG. 1 in the first preferred embodiment.

As described above, a first current path (the path where the diode D5 and the vertical correction coil L4 are connected in series) and a second current path (the path where the diode D6 and the vertical correction coil L5 are connected in series) are provided between the intermediate terminal P11 and the terminal P4 and are connected in common in parallel to the common resistor R2.

In the vertical correction unit 32, the passage of current is switched between the vertical correction coils L4 and L5 in the upper deflection and the lower deflection in the screen; in either case, a magnetic field produced by one of the vertical correction coils is directed to cancel the bias magnetic field of the magnets 2 and 3.

The structure of the intermediate pincushion distortion correcting saturable reactor unit 7 of the fifth preferred embodiment can be any of the structures of the intermediate pincushion distortion correcting saturable reactor units 1 of the first to fourth preferred embodiments, where the vertical correction coils L4 and L5 are concurrently (in substantially the same configuration) wound on the bobbin 5 in place of the vertical correction coil L3.

Figure 16:
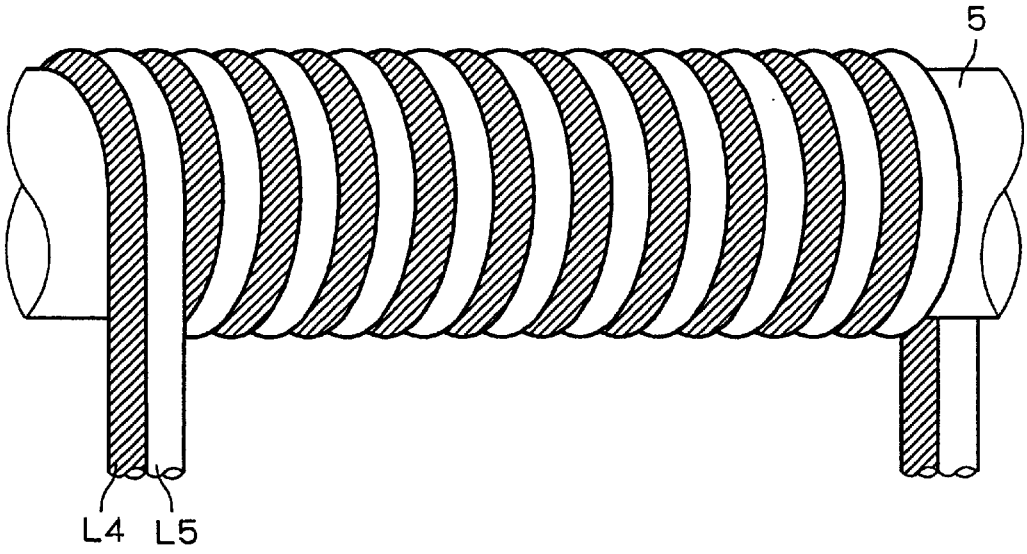
FIG. 16 is an explanation diagram showing how the vertical correction coils are wound in the fifth preferred embodiment.

In the vertical correction coils L4 and L5, two wires are wound concurrently and in the same direction on the bobbin 5 in a single winding process, whereby the vertical correction coils L4 and L5 are alternately wound on the bobbin 5 as shown in FIG. 16.

The direction of the magnetic fields produced by the vertical correction coils L4 and L5 can be controlled with the circuit interconnection on the substrate. Thus winding the two vertical correction coils L4 and L5 in almost the same paths suppresses variation in impedance. Further, the winding work can be accomplished in one process.

As compared with a circuit like the vertical correction unit 31 shown in FIG. 1 in the first preferred embodiment where the single vertical correction coil L3 is used in combination with a rectifier circuit such as diode bridge, the current passes through a smaller number of diodes in the vertical correcting unit 32 of the fifth preferred embodiment, and reduced power is consumed by the ON resistance of the diodes.

Sixth Preferred Embodiment

Figure 17:
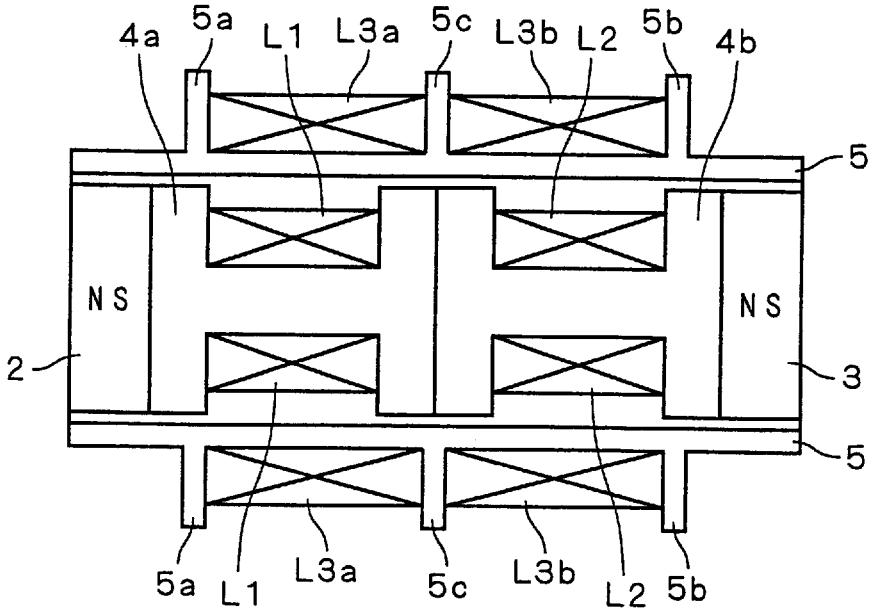
FIG. 17 is a sectional view showing the structure of the intermediate pincushion distortion correcting saturable reactor unit in an image distortion correcting device according to a sixth preferred embodiment of the invention.
Figure 18:
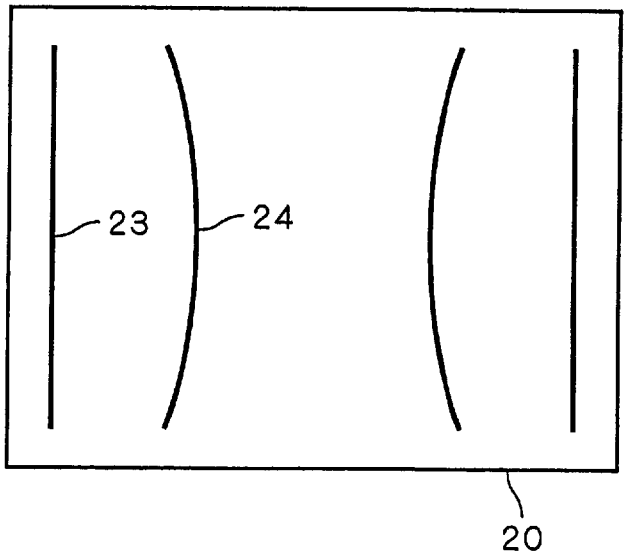
FIG. 18 is a schematic diagram showing intermediate pincushion distortion.
Figure 19:
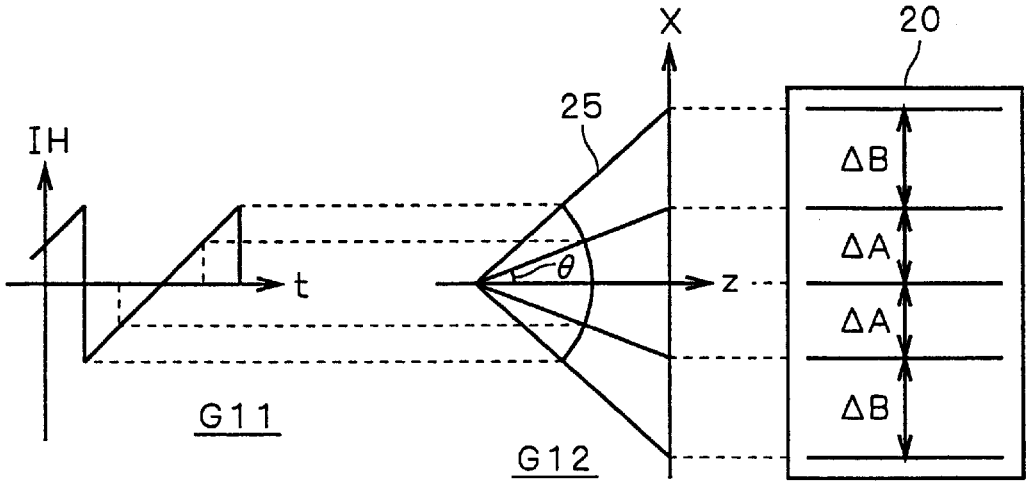
FIG. 19 is an explanation diagram showing display condition on a screen with a horizontal deflection current having a sawtooth waveform.
Figure 20:
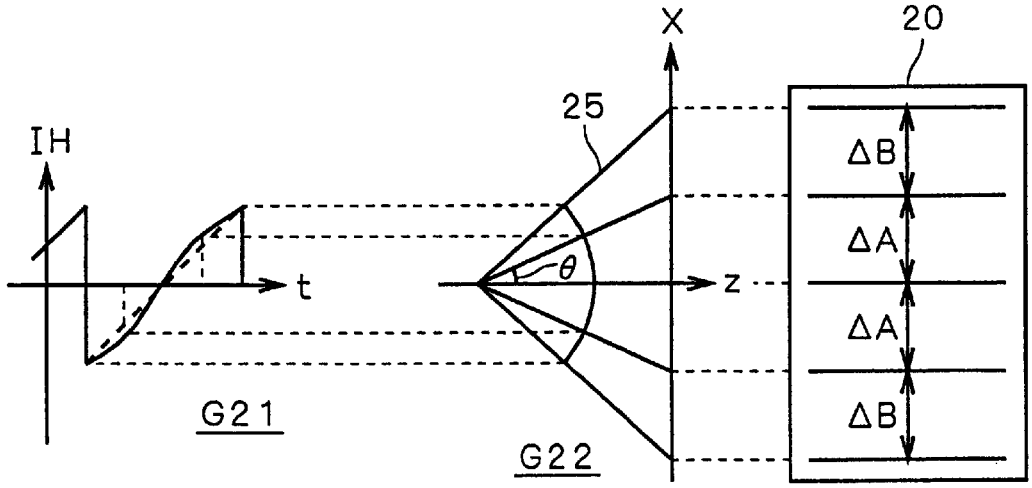
FIG. 20 is an explanation diagram showing display condition on a screen with a horizontal deflection current having an S-corrected sawtooth waveform.
Figure 21:
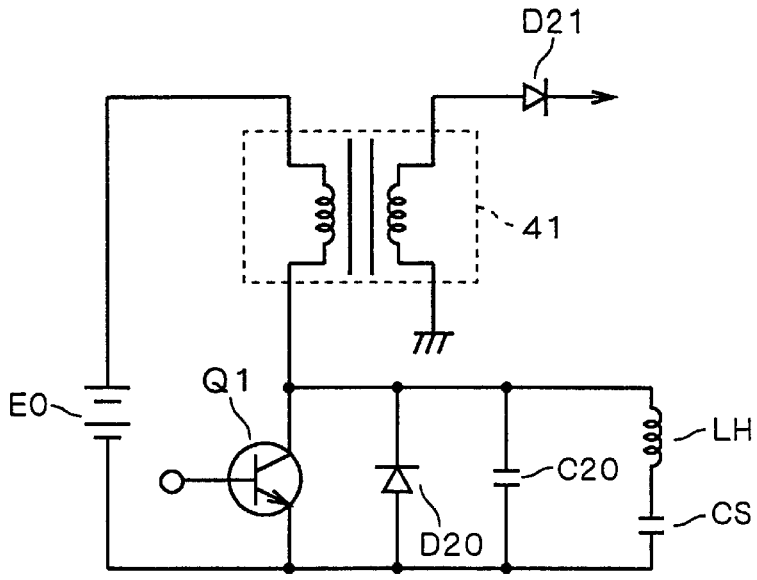
FIG. 21 is a circuit diagram showing an example of circuit configuration of a horizontal deflection circuit having an S-correction function.
Figure 22:
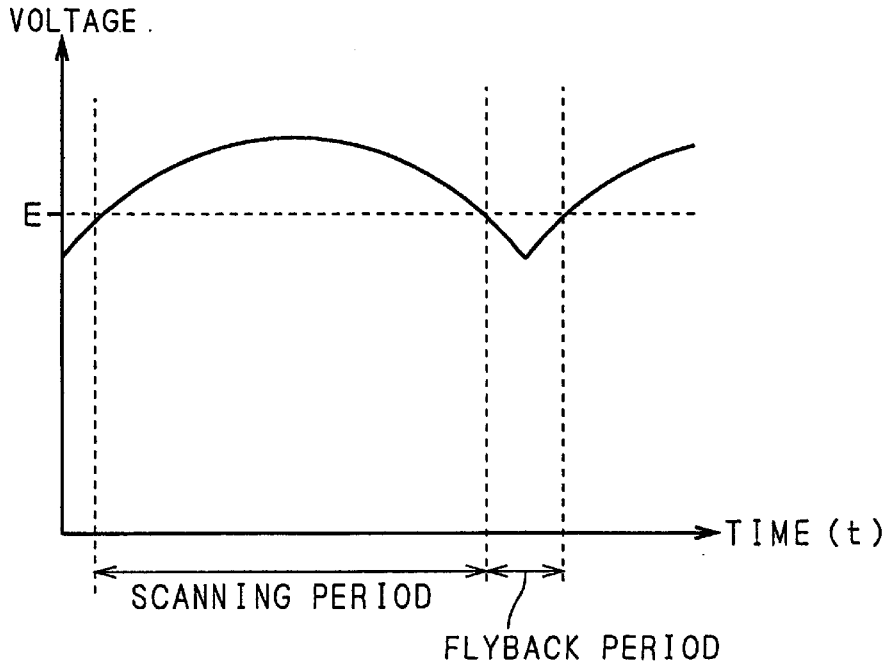
FIG. 22 is a graph showing distribution of voltage occurring at both ends of the S-correction capacitor.
Figure 23:
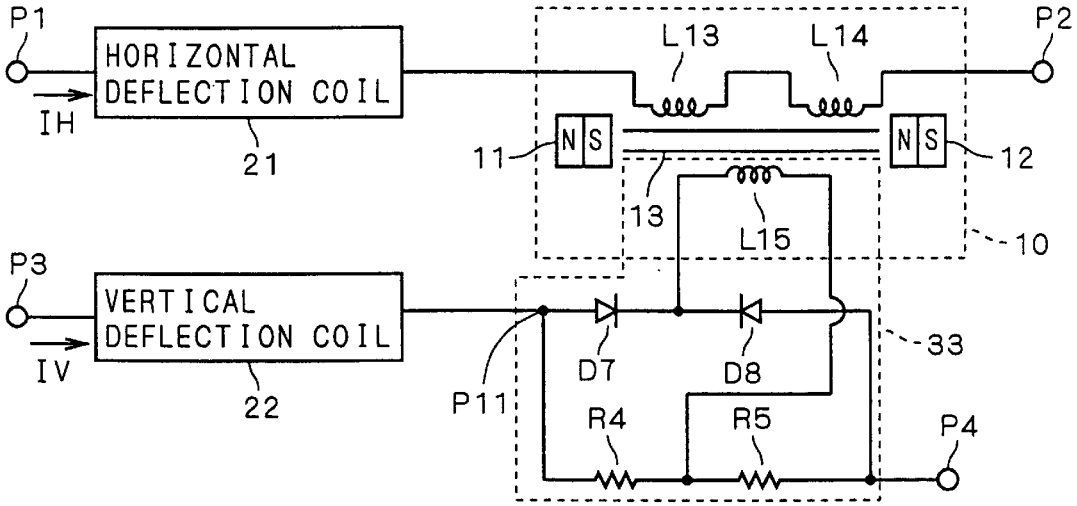
FIG. 23 PRIOR ART
FIG. 23 is a circuit diagram showing the structure of a conventional image distortion correcting circuit.
Figure 24:
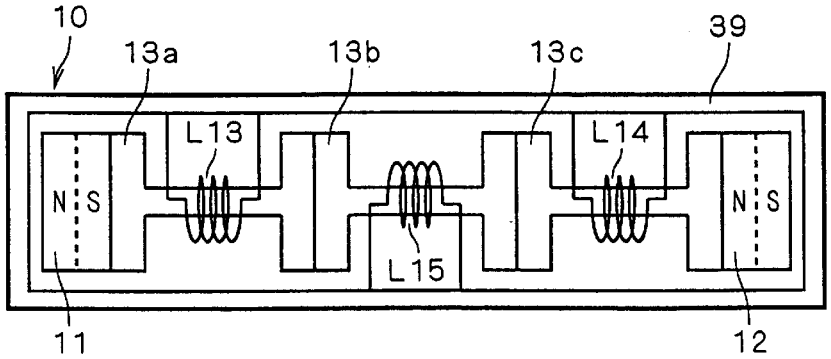
FIG. 24 PRIOR ART
FIG. 24 is a schematic side view showing the structure of the main part of a conventional intermediate pincushion distortion correcting saturable reactor unit.

FIG. 17 is a sectional view showing the structure of an intermediate pincushion distortion correcting saturable reactor unit in an image distortion correcting device according to a sixth preferred embodiment of the invention. The circuit configuration is the same as that of the image distortion correcting circuit shown in FIG. 1 in the first preferred embodiment or that shown in FIG. 15 in the fifth preferred embodiment.

As shown in this diagram, the bobbin 5 further comprises a collar 5*c* formed halfway between the collars 5*a* and 5*b* at both ends; the collar 5*c* is formed to control the number of turns of the vertical correction coil. The collar 5*c* may be integral with the bobbin 5 or may be combined with the bobbin 5 as a separate member. The position of the collar 5*c* corresponds to the middle position between the horizontal correction coils L1 and L2, or to the position of the contact surface between the partial cores 4*a* and 4*b*. The vertical correction coil L3 is formed of a series connection of two partial coils L3*a* and L3*b* sectioned by the collar 5*c*.

The partial vertical correction coil L3*a* is wound in a first peripheral region corresponding to the horizontal correction coil L1 between the collars 5*a* and 5*c*; the partial vertical correction coil L3*b* is wound in a second peripheral region corresponding to the horizontal correction coil L2 between the collars 5*b* and 5*c*. The partial vertical correction coils L3*a* and L3*b* are wound in the same direction for approximately the same number of turns. The structure is the same in other respects as that shown in FIG. 2 in the first preferred embodiment.

The image distortion correcting device thus constructed according to the sixth preferred embodiment can suppress induced (cross-talk) voltage occurring in the vertical correction coil L3 due to variation of the magnetic flux produced by the horizontal correction coils L1 and L2. That is, the cross-talk voltages occurring in the partial vertical correction coils L3*a* and L3*b* forming the vertical correction coil L3 have opposite polarities and the same absolute value, so that the cross-talk voltage is canceled in the entire vertical correction coil. This is described below in greater detail.

Since the partial vertical correction coil L3*a* is wound over the horizontal correction coil L1, it is largely affected by variation of the magnetic flux produced by the horizontal correction coil L1. The partial vertical correction coil L3*b* is largely affected by the magnetic flux produced by the horizontal correction coil L2. Since the partial vertical correction coils L3*a* and L3*b* are wound in the same direction and the magnetic fluxes produced by the horizontal correction coils L1 and L2 are in opposite directions, the polarities of the cross-talk voltages differ. That is to say, if, at a certain instant, the cross-talk voltage occurring in the partial vertical correction coil L3*a* is positive on the beginning side of the winding, then the cross-talk voltage occurring in the partial vertical correction coil L3*b* is opposite or negative on the beginning side of the winging. While the absolute values of the voltages are determined by the ratio between the number of turns of the horizontal correction coil L1 and the number of turns of the partial vertical correction coil L3*a* and the ratio between the number of turns of the horizontal correction coil L2 and the number of turns of the partial vertical correction coil L3*b*, the two are equal in this case. The cross-talk voltages occurring in the partial vertical correction coils L3*a* and L3*b* thus have opposite polarities and an equal absolute value.

Therefore no cross-talk voltage takes place at both ends of the vertical correction coil composed of the series-connected partial vertical correction coils L3*a* and L3*b*. Accordingly, in the circuit shown in FIG. 1, for example, no cross-talk current flows in the loop of the vertical correction coil L3 and diodes D2 and D4.

As described above, the structure of the sixth preferred embodiment can suppress cross-talk current flowing in the vertical correction coil and its peripheral circuitry in the horizontal periods, which reduces the amount of heat generated by the vertical correction coil or its peripheral circuitry. Further, current not intended in design does not flow in the vertical correction coil, e.g. a cross-talk current does not slow when the vertical deflection current should not flow in the vertical correction coil. Therefore the saturable reactor unit can appropriately operate to provide an increased amount of correction to the intermediate pincushion distortion.

If, by devising the way of winding, the vertical correction coil can be wound approximately the same number of turns in the region over the horizontal correction coil L1 and in the region over the horizontal correction coil L2, the collar 5*c* in the middle of the bobbin 5 can be removed.

Although the sixth preferred embodiment has shown an application to the image distortion correcting circuit shown in FIG. 1, an example of application to the image distortion correcting circuit shown in FIG. 15 is now described briefly. In this case, the vertical correction coils L4 and L5 are wound concurrently so that a partial vertical correction coil L3*a* formed of part of the vertical correction coil L4 and part of the vertical correction coil L5 is formed between the collars 5*a* and 5*c* and a partial vertical correction coil L3*b* formed of the remaining parts of the vertical correction coils L4 and L5 is formed between the collars 5*b* and 5*c*. The partial vertical correction coils L3*a* and L3*b* are wound in the same direction for approximately the same number of turns.

Seventh Preferred Embodiment

Assembled stranded wire (litz wire) may be used as the horizontal correction coils or vertical correction coil in any of the image distortion correcting devices shown in the first to sixth preferred embodiments. The use of litz wire increases the surface area of the coils, which suppresses increase in alternating-current resistance due to the skin effect. This reduces loss caused by a horizontal deflection current having large frequency and cross-talk current, thus reducing the amount of heat generated from the coils.

While the invention has been described in detail, the foregoing description is in all aspects illustrative and not restrictive. It is understood that numerous other modifications and variations can be devised without departing from the scope of the invention.

What is claimed is:

1. An image distortion correcting device comprising:

first and second horizontal correction coils provided on a horizontal deflection current path through which a horizontal deflection current flows, said first and second horizontal correction coils being connected in series and wound around a core in such directions that said first and second horizontal correction coils produce magnetic fields in opposite directions to each other;

magnetic field biasing means for biasing said magnetic fields in a first direction only; and a vertical correction coil provided on a vertical deflection current path through which a vertical deflection current flows, for producing a magnetic field in a second direction opposite to said first direction, wherein said vertical correction coil is wound over said first and second horizontal correction coils along the periphery of windings thereof.

2. The image distortion correcting device according to claim 1, wherein said core includes first and second partial cores, and said first and second horizontal correction coils include coils wound around said first and second partial cores, respectively.

3. The image distortion correcting device according to claim 1, wherein said core includes an integral single-unit core, and said first and second horizontal correction coils include coils wound in first and second regions of said integral core, respectively.

4. The image distortion correcting device according to claim 1, wherein said magnetic field biasing means includes first and second magnets provided at both ends of said core, with their polarities directed in the same direction.

5. The image distortion correcting device according to claim 2, wherein said magnetic field biasing means includes a single-unit magnet provided between said first and second partial cores.

6. The image distortion correcting device according to claim 1, further comprising a magnetically closing member connected to at least one of said magnetic field biasing means and said core, for forming a closed magnetic circuit together with said magnetic field biasing means and said core.

7. The image distortion correcting device according to claim 6, wherein said magnetically closing member includes a yoke plate arranged to be magnetically coupled with said magnetic field biasing means or said core.

8. The image distortion correcting device according to claim 1, wherein said vertical correction coil includes first and second vertical correction coils, said first vertical correction coil produces a magnetic field in said second direction when said vertical deflection current having a first polarity flows, and said second vertical correction coil produces a magnetic field in said second direction when said vertical deflection current having a second polarity flows opposite to said first polarity flows, and said first and second vertical correction coils include coils wound concurrently over the periphery of said first and second horizontal correction coils.

9. The image distortion correcting device according to claim 1, further comprising an insulating bobbin provided along the periphery of windings of said first and second horizontal correction coils, wherein said vertical correction coil includes a coil wound around said bobbin.

10. The image distortion correcting device according to claim 1, wherein said vertical correction coil includes coils wound approximately the same number of turns in first and second peripheral regions respectively corresponding to said first and second horizontal correction coils.

11. The image distortion correcting device according to claim 10, further comprising an insulating bobbin provided along the periphery of windings of said first and second horizontal correction coils, wherein said bobbin has a collar in a position corresponding to a middle position between said first and second horizontal correction coils.

12. The image distortion correcting device according to claim 1, wherein at least one of said first and second horizontal correction coils and said vertical correction coil includes a coil using assembled stranded wire as its winding.

* * * * *